US007021866B2

(12) United States Patent
Keefe

(10) Patent No.: US 7,021,866 B2
(45) Date of Patent: Apr. 4, 2006

(54) ARTICLE OF MANUFACTURE FOR ANCHORING POLES, TUBING, OR RODS IN SAND, OR OTHER SURFACE SEDIMENTS

(75) Inventor: David W Keefe, Portsmouth, NH (US)

(73) Assignee: Seacoast Industries, Inc., Wilmington, DE (US)

( * ) Notice: Subject to any disclaimer, the term of this patent is extended or adjusted under 35 U.S.C. 154(b) by 0 days.

(21) Appl. No.: 10/252,885

(22) Filed: Sep. 23, 2002

(65) Prior Publication Data

US 2004/0057799 A1 Mar. 25, 2004

(51) Int. Cl.
*E02D 27/50* (2006.01)
*E02D 5/74* (2006.01)
*E04H 15/26* (2006.01)

(52) U.S. Cl. ..... 405/244; 405/259.1; 52/155; 52/157; 135/99

(58) Field of Classification Search ..... 405/259.1, 405/244; 52/155, 156, 157; 135/16, 98, 135/99; 248/85, 87, 156, 530, 532, 545, 248/547

See application file for complete search history.

(56) References Cited

U.S. PATENT DOCUMENTS 3,736,711 A * 6/1973 Thornbrugh ..... 52/157
5,358,209 A * 10/1994 Ward ..... 248/545
5,457,918 A * 10/1995 Plourde ..... 248/545
5,535,978 A 7/1996 Rodriguez
5,662,304 A * 9/1997 McDaniel ..... 52/157
6,032,880 A * 3/2000 Verrills et al. ..... 248/156
6,082,157 A 7/2000 Boyce
6,199,569 B1 * 3/2001 Gibson ..... 135/16
6,247,276 B1 * 6/2001 Masters et al. ..... 52/169.12
6,481,364 B1 * 11/2002 Woyjeck ..... 52/157
2001/0017150 A1 8/2001 Doreste
2001/0030064 A1 10/2001 Thompson
2001/0035291 A1 11/2001 Kuzmic

FOREIGN PATENT DOCUMENTS

EP 312675 * 4/1989 ..... 135/16

* cited by examiner

*Primary Examiner*—Jong-Suk (James) Lee
(74) *Attorney, Agent, or Firm*—Shaheen & Gordon; Arpiar Saunders

(57) ABSTRACT

The invention is an article of manufacture that has for its purpose, the anchoring of a pole, tube or rod in sand or other sediments. The principal anchoring element is a broad flange auger having a receptacle mounted on top of the auger for insertion of the bottom portion of the pole, tube, or rod, which is to be supported by the anchoring device. When not in use, and during transport to the location of use, the auger is covered by a tubular sheath, which covers the auger up to the receptacle on top, as a protection against the sharp edges of the auger. When removed from the auger, the sheath is used as a handle for turning the auger by use of a locking system that attaches the sheath or handle to the receptacle at the top of the auger. As the handle turns the auger, the auger penetrates the sediments, providing a stable anchor for the pole, tube, or rod. The round pointed end of the sheath may also be used for creating a starter hole in the beach sand or ground surface to begin the operation of the auger.

7 Claims, 7 Drawing Sheets

ARTICLE OF MANUFACTURE FOR ANCHORING POLES, TUBING, OR RODS IN SAND, OR OTHER SURFACE SEDIMENTS

FIELD OF THE INVENTION

This invention relates generally to the field of construction, and more particularly to an article of manufacture for Anchoring Poles, Tubing, or Rods in Sand, or Other Surface Sediments.

BACKGROUND OF THE INVENTION

Forcing a tube with a serrated edge into the beach sand can require considerable time and energy and can provide weak support for a beach umbrella unless the penetration is quite deep. Carrying a relatively large container as a beach safe and foundation to support a beach umbrella is cumbersome and inconvenient. Driving a pole standard into the ground as a support for a beach umbrella can require considerable effort and time to achieve the penetration of the beach sand necessary to assure a stable support for the beach umbrella. A self contained drilling and excavation tool for placing a support in the sand to hold a beach umbrella would appear to require transporting a relatively heavy, quite complicated device to the beach to accomplish what should be a fairly simple task. This approach does not seem to be what most people would want to do in providing a support for a beach umbrella. The impact-type slide hammer device for driving a tube into the beach sand as a support for an umbrella, as with other hammering devices, would require a considerable amount of effort and time, and the device may be cumbersome to transport. In my invention all of the above stated deficiencies are overcome with the light weight auger anchoring mechanism. Because there is an element permanently mounted on top of the auger, which has a receptacle at its top for insertion of an umbrella pole and a cranking cradle permanently attached to its side as a connection for the cranking handle, my invention has only two separate components. One of these is the auger with the element on top and the other is the sheath, which serves as the cranking handle when it has been removed from its protective position over the auger. This compact, two component system has been designed to be easy to transport, and quick and easy to install and remove. With the protective sheath covering the auger, the whole device is easily transported in a relatively small canvas bag.

SUMMARY OF THE INVENTION

The primary object of the invention is to provide a better means of erecting temporary structures and facilities on the ground surface.

Another object of the invention is to provide a means of anchoring these facilities in a manner that will support the weight of the structures above the ground surface.

Another object of the invention is to provide a means of quickly setting up surface structures without major physical exertion.

A further object of the invention is to provide components for erecting these temporary structures that are light and easily transported.

Yet another object of the invention is to provide a means of anchoring those surface structures against wind forces blowing across the ground surface.

Still yet another object of the invention is to provide a means of easily transporting the components of this anchoring system without danger to persons using them.

Another object of the invention is to provide an anchoring system that is versatile enough to accommodate a large number of usages.

Another object of the invention is to provide an anchoring system for these structures that is relatively low cost.

A further object of the invention is to provide a means for connection to the anchoring system that is versatile enough to accommodate many types of surface structures.

Other objects and advantages of the present invention will become apparent from the following descriptions taken in connection with the accompanying drawings, wherein, by way of illustration and example, an embodiment of the present invention is disclosed.

An article of manufacture for Anchoring Poles, Tubing, or Rods in Sand, or Other Surface Sediments comprising a broad flange auger to set in the beach sand or other ground surface sediments, a component mounted on top of the auger with a receptacle to accommodate various above surface structural elements, a guard or sheath to protect the user from the sharp edges and point of the auger, a means for holding the guard or sheath in a protective position over the auger, a means for turning the auger to achieve ground penetration, a handle for turning the auger, a locking system to attach the handle to the component mounted on top of the auger, a means for creating a starter hole in the beach sand or ground surface to begin the operation of the auger, and a means of easily carrying the components to the location where they are to be used.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

To enable others skilled in the art to make and use my invention, I will describe its construction and operation. The general description of my invention is An Article of Manufacture for Anchoring Poles, Tubing or Rods in Surface Soil or Sediments. For the most part, devices for such anchoring are for the support of surface structures, and most frequently light surface structures. Most of the devices that have been developed to serve this function are based upon the concept of forcing a pole, rod or tubing down into the sand or other surface sediments to a depth sufficient to provide a stable support for the structure erected above them. My invention departs significantly from this concept while providing a stronger improved anchor support. In order to describe its components and the operation of my invention, I will use the figures included in this application.

Figure 1:
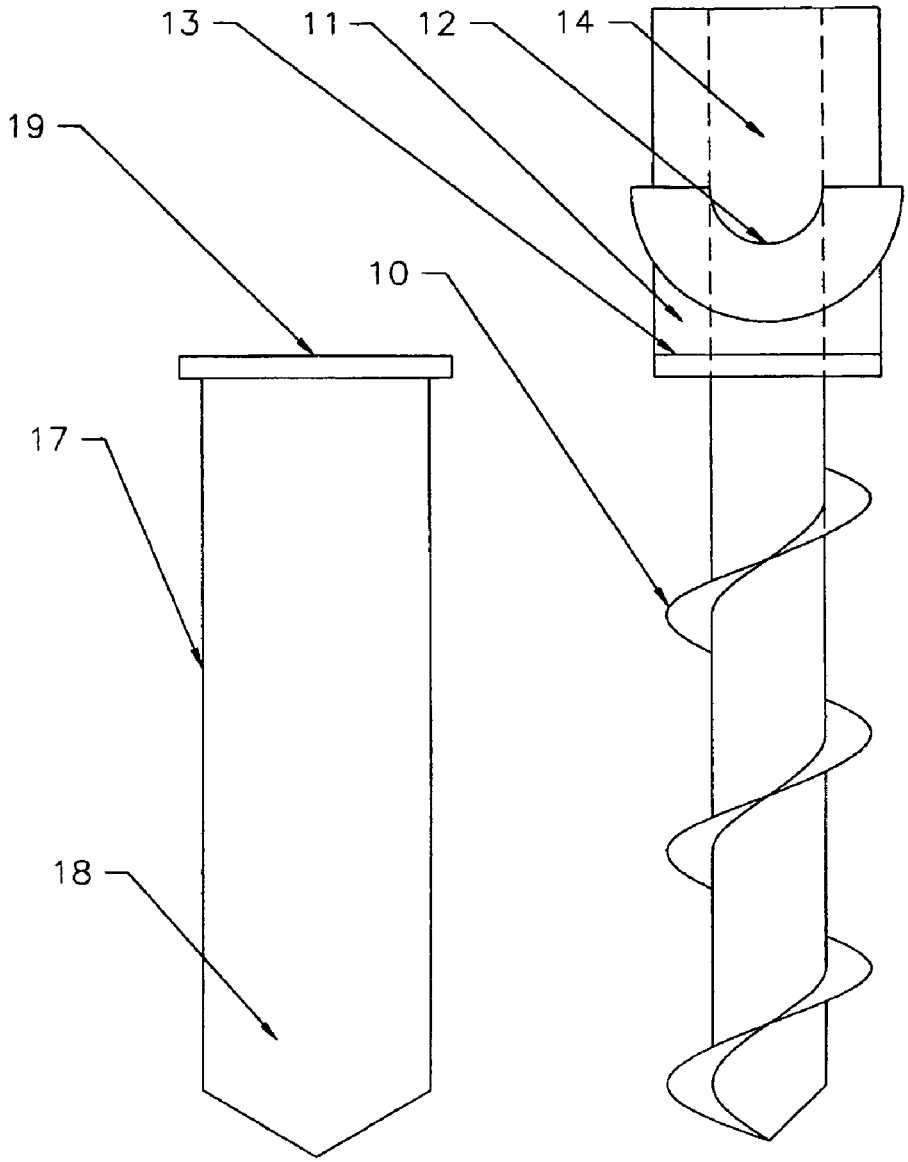
FIG. 1 is an elevational view of the invention's two component system used to establish a firm support for a beach umbrella or other light surface structure.
Figure 2:
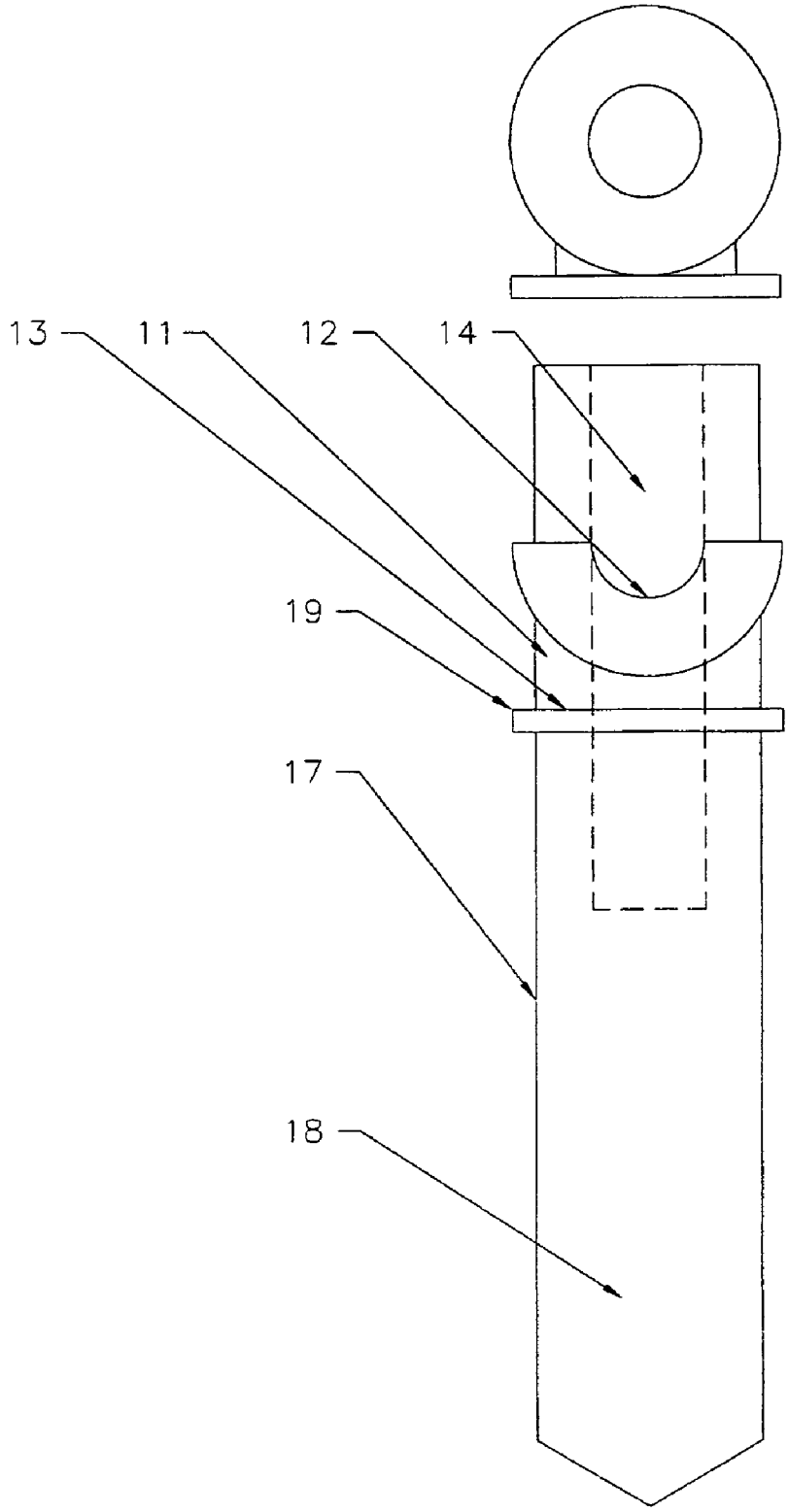
FIG. 2 is an elevational view of the invention showing both components connected in a mode that protects the user during transport.

Turning first to FIG. 1, it will be observed that the sheath, 17, has been removed from the broad flanged auger and is on the left side of the drawing. The sheath is constructed with a round pointed bottom, 18, and an outsize ring at its top, 19. On the right side of the drawing, the auger, 10, is constructed with a broad flange, and a receptacle body, 11, mounted at its top. The receptacle body is constructed with an open receptacle, 14, at its top, a half circle or U-shaped cranking cradle, 12, attached to its side, and a retainer ring, 13, circling its bottom portion to hold the sheath in place when it is covering the auger during transport of the device. In FIG. 2, the sheath, 17, is covering the auger and the auger cannot be seen. The outsize ring, 19, has slipped over the retainer ring, 13, and holds the sheath in place. It will be seen that this invention has the advantage of being very compact. There are only two separate components; the sheath, 19, which also serves as the crank handle, and the auger which has the receptacle body, 11, permanently mounted on its top. With the sheath in place as a protective cover for the auger, the device can be easily transported to the beach or other location in a relatively small canvas bag. When arriving at the location where it is to be used, the sheathed device with its round pointed bottom, 18, is used to make a starter hole in the sand or ground surface. This step is not essential, but it facilitates the quick penetration of the auger in establishing a firm support for the beach umbrella or other upper pole device.

Figure 3:
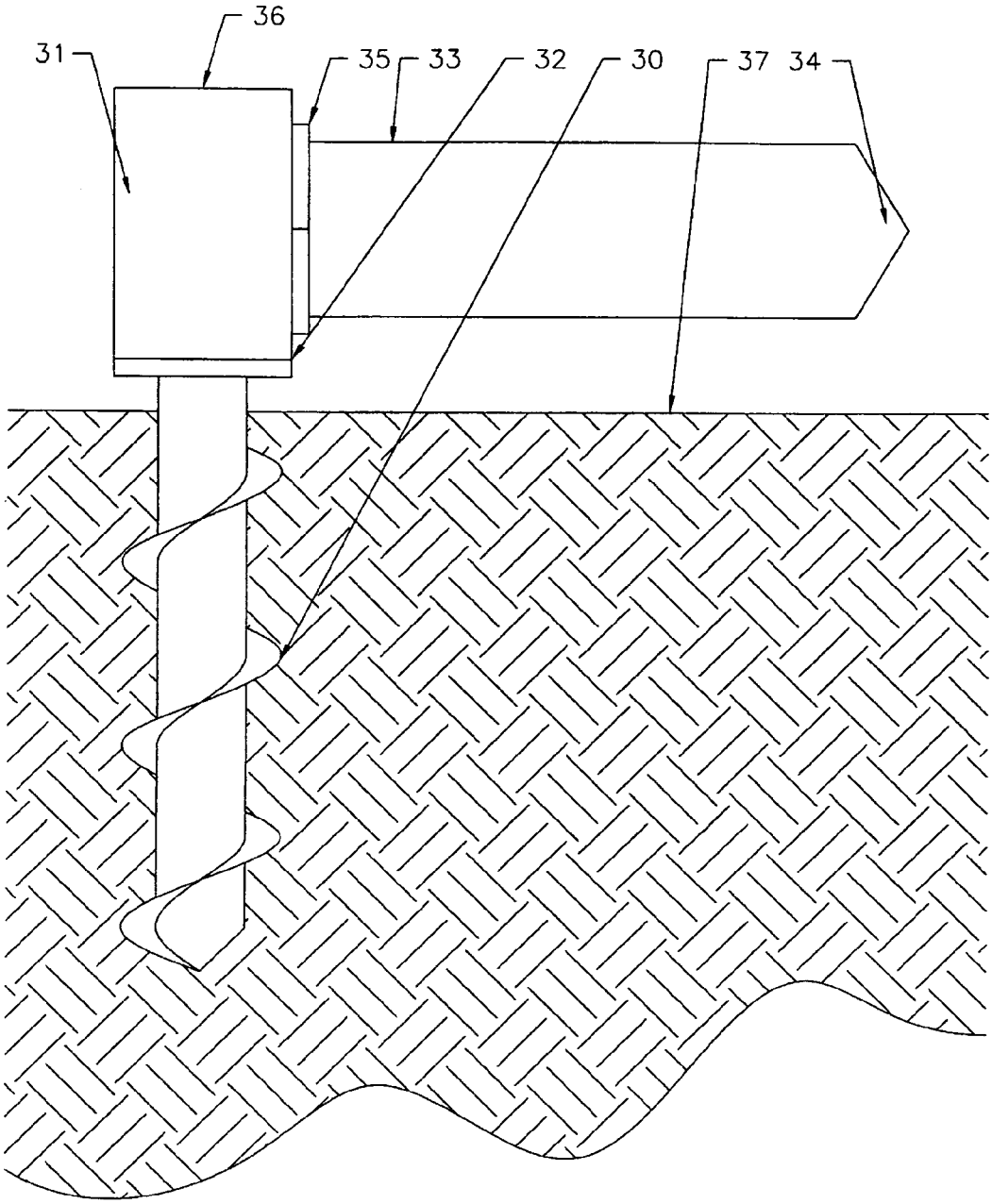
FIG. 3 is a plan view of the invention showing the two components connected in a mode that provides for the rigid penetration of the auger anchor into the beach sand or ground surface.

Turning now to FIG. 3, for a description of the operation of the invention, it will be seen that the sheath has been removed and becomes the cranking handle, 33, with its outsize ring slipped down into the cranking cradle, 35, attached to the receptacle body, 31, which is permanently mounted on top of the auger, 30. By combining the two functional requirements in one component, as with the sheath serving both as a protective cover for the auger and as the cranking handle, the weight of the invention is kept as low as possible, and the overall efficiency of the device is enhanced. In operation, the cranking handle, 33, is turned to the right after the auger, 30, has been inserted in the starter hole. As the cranking handle, 33, turns, the auger, 30, is drawn down into the sand or other sediments below the ground surface, 37, to provide a firm anchor for a beach umbrella or other upper pole device which is inserted into the open receptacle, 36, at the top of the receptacle body, 31, mounted on the top of the auger, 30. This invention provides a much easier means of establishing a firm anchor for supporting surface structures than is possible through means of driving a pole into the ground surface, and because it is light weight, it is much superior to devices that are carried to the beach as a weighted support for beach umbrellas and other devices. It should be noted that the auger sheath, when used as a cranking handle, 33, is long enough so that when it is gripped at the round pointed end, 34, considerable leverage is available to turn the handle and set the auger firmly in the sand or other surface sediments with a minimum of exertion. When leaving the location, the auger, 30, may be withdrawn by reversing direction and turning the cranking handle, 33, to the left. The auger, 30, alternatively, may be constructed with a left hand twist, instead of a right hand twist, and therefore requiring a left hand turn to set it in the ground and a right hand turn to withdraw the auger. The invention has the advantage of providing a quick and easy means of removing the installation from the ground surface by reversing the direction of cranking from that used to install the auger in the ground. In FIG. 3, the retainer ring, 32, is also visible but serves no purpose during this phase of operation of the device. The same operating procedure is followed in establishing the auger anchors for all upper pole devices, but the augers may be larger if the weight to be supported is greater or the device is subject to wind or other forces.

Figure 4:
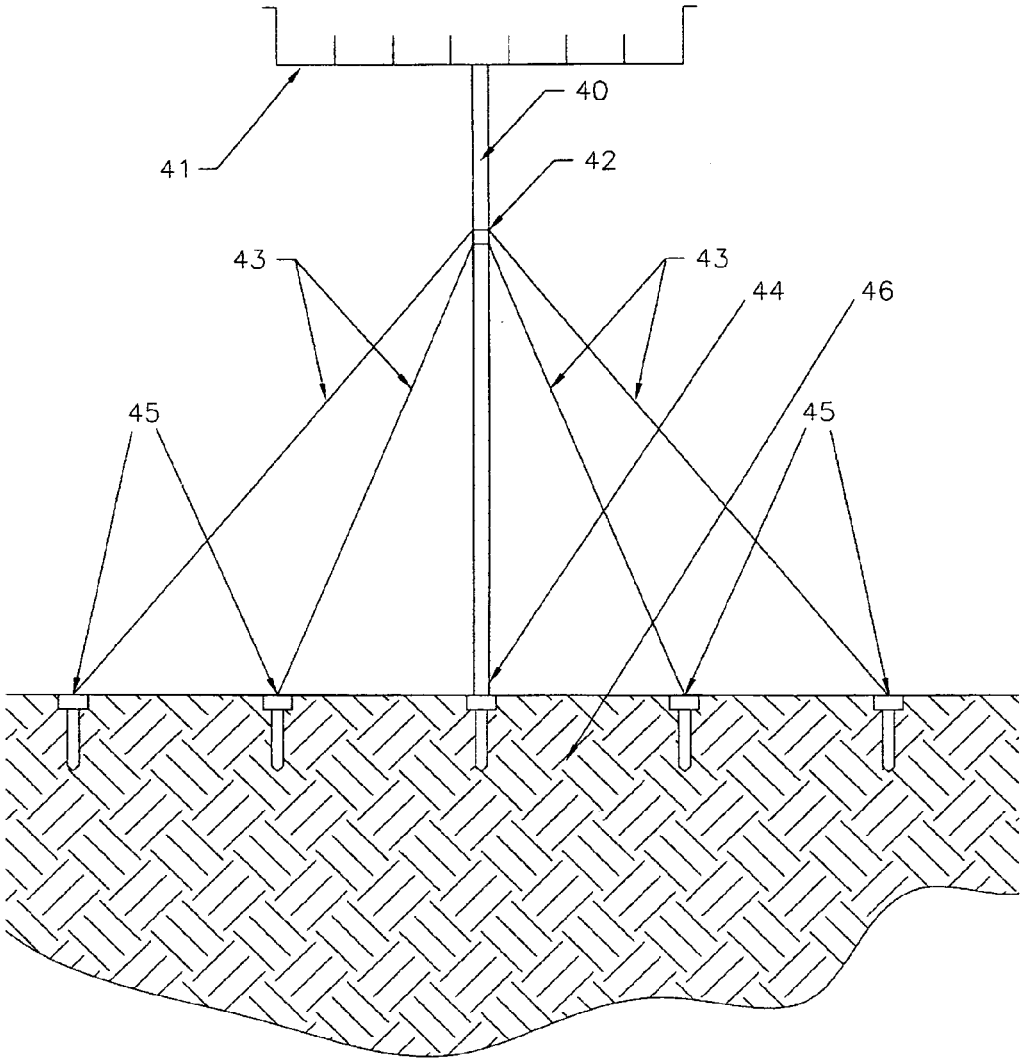
FIG. 4 is an elevational view of one embodiment of the invention wherein a set of auger anchoring devices is used to provide the necessary supports for a field radio antenna.

The versatility of my invention in providing a firm support or supports for surface structures is illustrated in one embodiment shown in FIG. 4 where several auger anchoring devices are used to support a field radio antenna. As can be seen, the antenna mast, 40, is supported by an auger anchoring device at its base, 44, while guy wires, 43, running from the guy wire ring, 42, to smaller auger anchoring devices, 45, set in the ground surface, 46, give added stability in supporting the weight of the antenna array, 41, and resistance to wind forces. With this invention a small crew of men can erect a field antenna in a matter of minutes, and disassemble it just as quickly.

Figure 6:
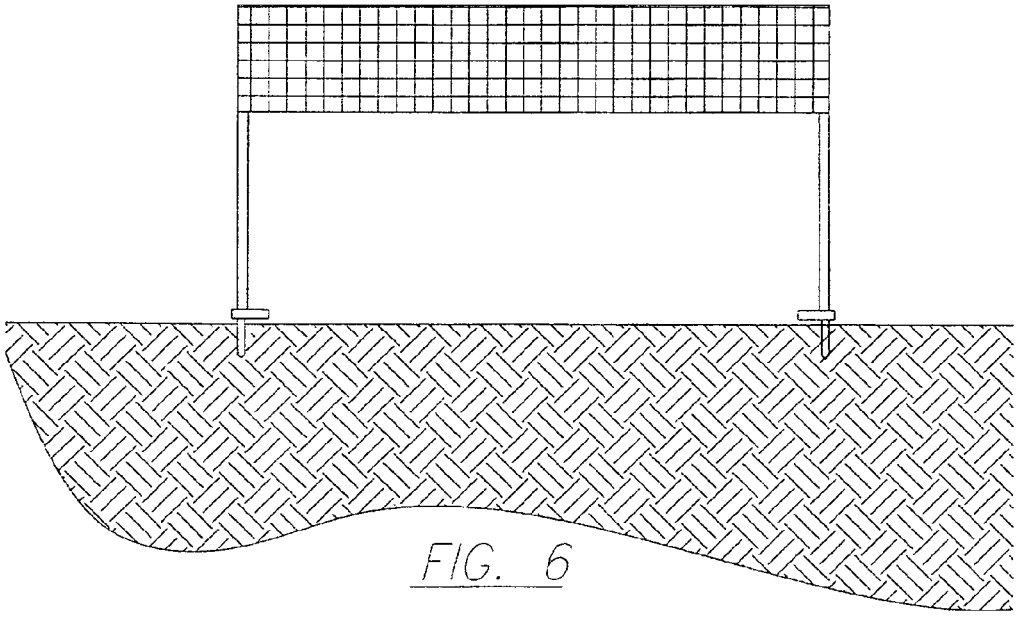
Figure 7:
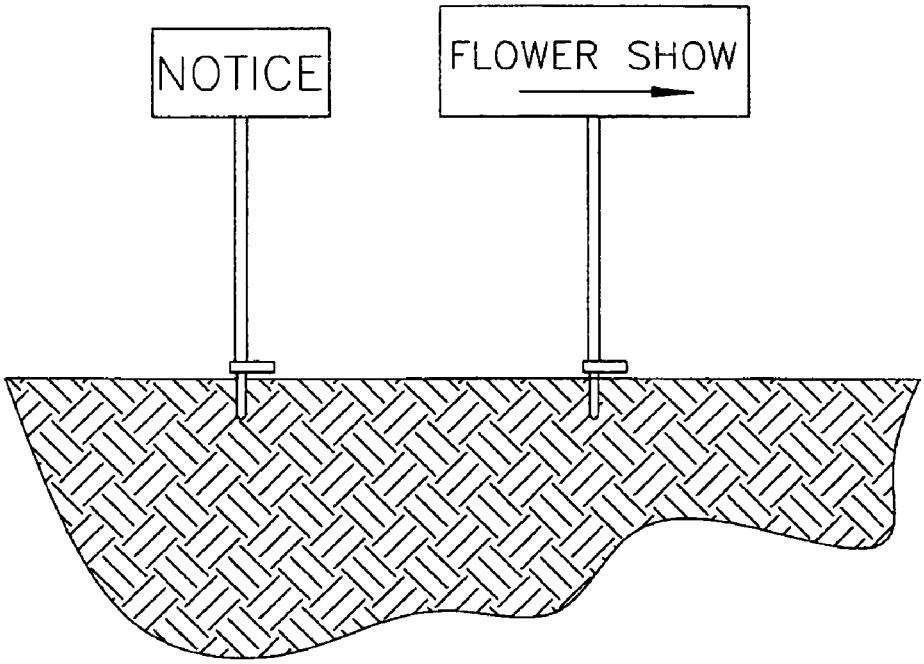
Figure 8:
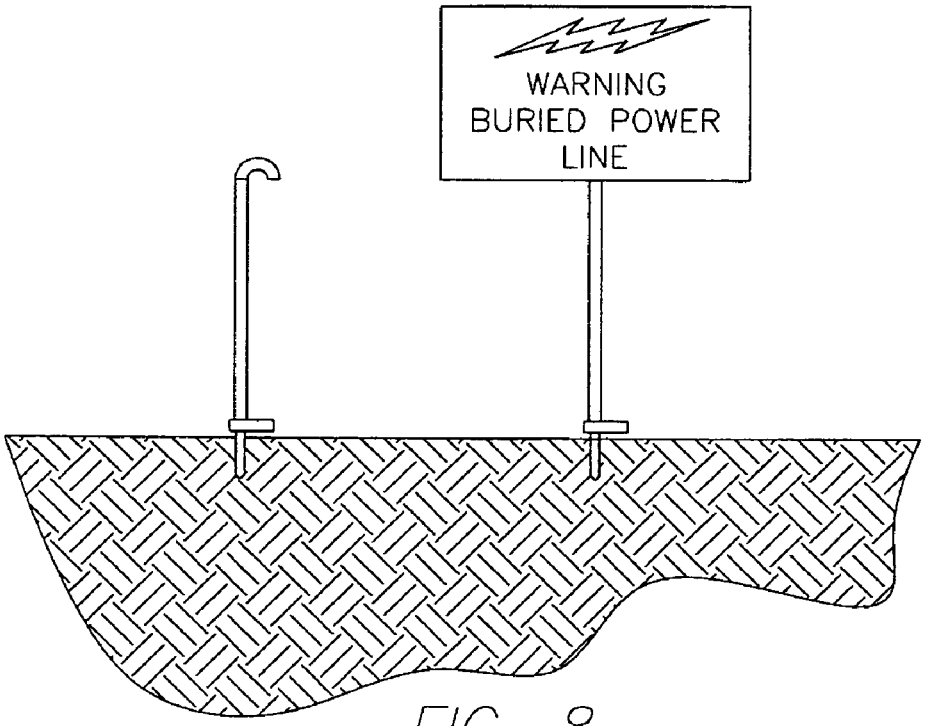
Figure 9:
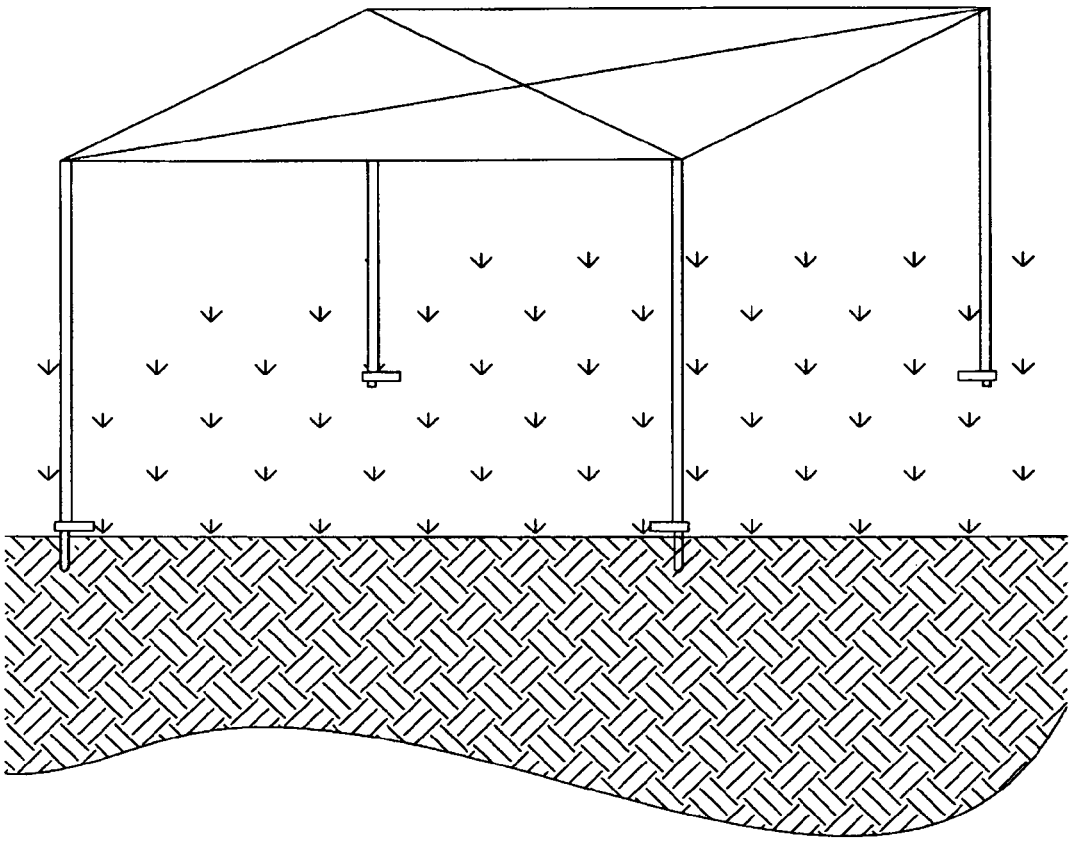

As illustrated in FIG. 6, the invention offers quick and easy installation for games played with a net at the beach or other ground surface location, such as badminton and volley ball. The same type of installation can be the foundation for erecting signs and warning alert devices along roadways, as illustrated in FIGS. 7 and 8, again having the advantage of quick and easy installation. The same can be said of using this type of auger anchoring device as the foundation for tents, awnings and other surface structures in play grounds, and civilian and military camps and in field service exercises, as illustrated in FIG. 9.

Depending upon the weight and strength considerations for the particular usage, the auger anchoring devices may be constructed using strong plastics as well as various metals. The augers may also be constructed with thicker, broader flanges for improved support for heavier above ground facilities.

Figure 5:
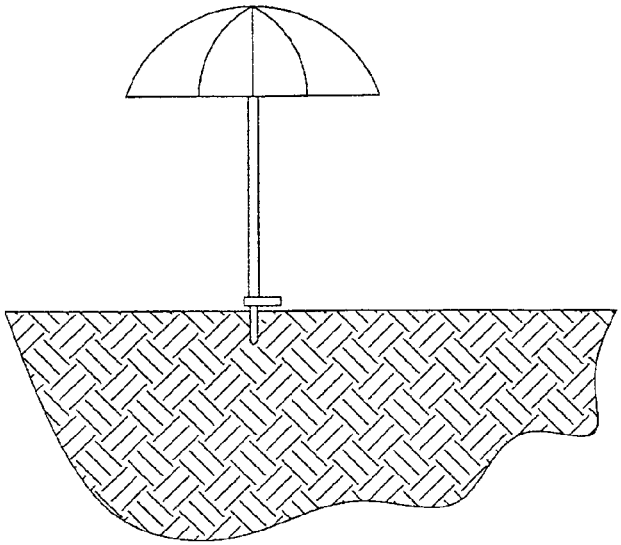
FIGS. 5,6,7,8, and 9 respectively, show embodiments of the invention as used to support the pole of an umbrella, poles are for a badminton net, poles to support advertising or other signs, poles to support signs or markers warning of hazards, and poles to support an awning or tent.

The constant component in all of the embodiments of the invention is a broad flanged auger having an element mounted on its top with a receptacle, or clamping mechanism, to accept and support above surface structures or facilities after the auger has been set below the surface in the beach sand or other ground surface sediments. The principle advantages of the invention are quick and easy installation and removal, and ease of transport. The preferred embodiment is mounting a beach umbrella in the receptacle, after the auger has been anchored or set in the beach sand as illustrated in FIG. 5.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An article of manufacture for anchoring poles, tubing or rods in sand, or other surface sediments comprising:

an auger consisting of an elongate body of circular cross section coming to a point at its bottom end and being open at its top end;

a spiraling broad flange commencing just above said point at the bottom end of said elongate body and terminating near the top open end of said elongate body;

a receptacle body mounted on top of the said elongate body with a receptacle on top of said receptacle body to accommodate various ground surface structural elements;

a sheath of tubular dimension with a rounded point on its bottom end and being open at its top end to protect the user from the point and edges of said spiraling broad flange by sliding said sheath over the said elongate body of the auger;

a retainer ring on the top end of said elongate body at the point of said termination of said spiraling broad flange to hold said sheath in place over said elongate body and said spiraling broad flange;

a means for converting the aforesaid sheath to use as a cranking handle for turning the auger to achieve ground penetration consisting of a locking system with an outsize ring at the top end of said sheath and a U-shaped cranking cradle mounted on the side of said receptacle body mounted on top of the elongate body of the auger;

the outsize ring, of appropriate dimensions to allow its being firmly seated in the aforesaid cranking cradle when the sheath is removed from the auger body, thereby allowing the sheath to be locked in a new position perpendicular to the body of the auger;

the locking system comprising of the outsize ring at the top of the sheath seated in the aforesaid cranking cradle to allow the sheath to be used as a handle to turn the auger and cause it to penetrate the sand or other ground surface;

a means for creating a starter hole in the beach sand or ground surface by manually inserting said rounded point at the bottom of said sheath into the ground surface;

a canvas bag for carrying the auger anchoring device to the location where it will be used.

2. An article of manufacture for anchoring poles, tubing or rods in surface soil or sediments, as claimed in claim 1, wherein the auger anchoring device is set firmly in the beach sand or other sediment through rotation of the aforesaid cranking handle and the open receptacle at the top of the aforesaid receptacle body mounted on top of the auger is used to accommodate the insertion of the removable bottom pole of a beach umbrella thereby providing a firm support for said umbrella.

3. An article of manufacture for anchoring poles, tubing or rods in surface soil or sediments, as claimed in claim 1, wherein two auger anchoring devices spaced at a measured distance from each other are set firmly in the beach sand or other surface sediments through the rotation of the aforesaid cranking handle on each of these devices and the open receptacle at the top of the aforesaid receptacle body mounted on the top of these auger anchors are used to accommodate the insertion of removable poles for erection of a net for playing badminton, volley ball, or other games requiring a net.

4. An article of manufacture for anchoring poles, tubing or rods in surface soil or sediments, as claimed in claim 1, wherein said top of the receptacle body mounted on top of the auger provides an open receptacle for a pole for erecting a field radio antenna having guide wires attached to the upper lengths of said pole which are also anchored into the surface soil or sediments with smaller but otherwise identical auger anchoring devices to give added stability to said radio antenna pole.

5. An article of manufacture for anchoring poles, tubing or rods in surface soil or sediments, as claimed in claim 1, further comprising several auger anchoring devices as claimed in claim 1, for use in erecting field tents and outdoor awnings for military or civilian use with the size of said auger anchoring devices and the size of the aforesaid receptacles at the top of said auger anchoring devices varying according to the requirements of poles used in erecting said tents and awnings.

6. An article of manufacture for anchoring poles, tubing or rods in surface soil or sediments, as claimed in claim 1, wherein said top of the receptacle body mounted on top of the auger provides an open receptacle for a removable pole for erecting outdoor signs or notices.

7. An article of manufacture for anchoring poles, tubing or rods in surface soil or sediments, as claimed in claim 1, wherein said top of the receptacle body mounted on top of the auger provides an open receptacle for a removable pole supporting warning alert devices for buried pipelines and electrical lines.

* * * * *